US011274515B2

(12) United States Patent
Grimsbo et al.

(10) Patent No.: US 11,274,515 B2
(45) Date of Patent: Mar. 15, 2022

(54) METHOD OF PLUGGING AND PRESSURE TESTING A WELL

(71) Applicant: EQUINOR ENERGY AS, Stavanger (NO)

(72) Inventors: Gjermund Grimsbo, Trondheim (NO); Pål Viggo Hemmingsen, Trondheim (NO); Halvor Kjørholt, Trondheim (NO); Gisle Stjern, Trondheim (NO)

(73) Assignee: EQUINOR ENERGY AS, Stavanger (NO)

( * ) Notice: Subject to any disclaimer, the term of this patent is extended or adjusted under 35 U.S.C. 154(b) by 127 days.

(21) Appl. No.: 16/347,733

(22) PCT Filed: Nov. 6, 2017

(86) PCT No.: PCT/NO2017/050285
§ 371 (c)(1),
(2) Date: May 6, 2019

(87) PCT Pub. No.: WO2018/084719
PCT Pub. Date: May 11, 2018

(65) Prior Publication Data

US 2019/0257169 A1 Aug. 22, 2019

(30) Foreign Application Priority Data

Nov. 7, 2016 (GB) ..... 1618747

(51) Int. Cl.
*E21B 47/117* (2012.01)
*E21B 33/13* (2006.01)
(Continued)

(52) U.S. Cl.
CPC ..... *E21B 29/02* (2013.01); *E21B 33/126* (2013.01); *E21B 33/13* (2013.01); *E21B 43/116* (2013.01); *E21B 47/06* (2013.01); *E21B 47/117* (2020.05)

(58) Field of Classification Search
None
See application file for complete search history.

(56) References Cited

U.S. PATENT DOCUMENTS 2,918,124 A 12/1959 Spearow
3,053,182 A 9/1962 Christopher
(Continued)

FOREIGN PATENT DOCUMENTS

CA 1 246 987 A 12/1988
CN 101403296 A 4/2009
(Continued)

OTHER PUBLICATIONS

International Search Report, issued in PCT/NO2017/050285, dated Jan. 19, 2018.
(Continued)

*Primary Examiner* — Charles R Nold
(74) *Attorney, Agent, or Firm* — Birch, Stewart, Kolasch & Birch, LLP

(57) ABSTRACT

A method of plugging a well extending into a formation to facilitate temporary or permanent abandonment of the well. The method includes conveying a plug placement and verification tool (PPVT) through the well, to a plug formation location, the PPVT including a stinger for delivering a plugging material into the well, an expandable packer disposed at one end of the stinger and a pressure sensor disposed below the expandable packer, and operating the expandable packer to form a seal in the well above the pressure sensor. The method further includes delivering a
(Continued)

plugging material from the stinger into a region of the well above the expandable packer, thereby forming a plug in the well, and thereafter creating a pressure change above the plug and verifying the integrity of the plug using the pressure sensor.

18 Claims, 6 Drawing Sheets

(51) Int. Cl.

| | |
|---|---|
| ***E21B 47/06*** | (2012.01) |
| ***E21B 29/02*** | (2006.01) |
| ***E21B 33/126*** | (2006.01) |
| ***E21B 43/116*** | (2006.01) |

(56) References Cited

U.S. PATENT DOCUMENTS

| | | | | |
|---|---|---|---|---|
| 5,339,901 | A | 8/1994 | McKinzie | |
| 5,372,198 | A | 12/1994 | North et al. | |
| 5,667,010 | A | 9/1997 | Boyd et al. | |
| 6,382,315 | B1 * | 5/2002 | Langseth | E21B 49/081 166/252.1 |
| 6,478,086 | B1 | 11/2002 | Hansen | |
| 2003/0150614 | A1 | 8/2003 | Brown et al. | |
| 2005/0028980 | A1 | 2/2005 | Page et al. | |
| 2005/0263282 | A1 | 12/2005 | Jeffrey et al. | |
| 2005/0279510 | A1 * | 12/2005 | Patel | E21B 17/026 166/380 |
| 2006/0196679 | A1 * | 9/2006 | Brisco | E21B 43/105 166/384 |
| 2007/0000665 | A1 | 1/2007 | Tudor et al. | |
| 2007/0163783 | A1 | 7/2007 | Head | |
| 2008/0314951 | A1 | 12/2008 | Kosuge et al. | |
| 2009/0260817 | A1 | 10/2009 | Gambier et al. | |
| 2009/0326826 | A1 | 12/2009 | Hull et al. | |
| 2013/0133883 | A1 * | 5/2013 | Hill, Jr. | E21B 47/06 166/250.17 |
| 2013/0312963 | A1 * | 11/2013 | Larsen | E21B 41/00 166/285 |
| 2014/0117848 | A1 * | 5/2014 | Meyer | H01J 61/125 313/643 |
| 2014/0318770 | A1 | 10/2014 | Hallundbæk et al. | |
| 2015/0068738 | A1 | 3/2015 | Wayne et al. | |
| 2015/0159480 | A1 | 6/2015 | Kalyanaraman et al. | |
| 2015/0300154 | A1 | 10/2015 | Hallundbæk et al. | |
| 2016/0010415 | A1 * | 1/2016 | Myhre | E21B 29/04 166/290 |
| 2017/0067313 | A1 * | 3/2017 | Connell | E21B 37/00 |

FOREIGN PATENT DOCUMENTS

| | | | |
|---|---|---|---|
| CN | 101680295 | A | 3/2010 |
| CN | 103930645 | A | 7/2014 |
| CN | 104755700 | A | 7/2015 |
| GB | 2519419 | A | 4/2015 |
| GB | 2523910 | A | 9/2015 |
| NO | 20151746 | A1 | 10/2016 |
| WO | WO 99/60250 | A1 | 11/1999 |
| WO | WO 2004/016901 | A1 | 2/2004 |
| WO | WO 2012/096580 | A1 | 7/2012 |
| WO | WO 2014/117846 | A1 | 8/2014 |
| WO | WO 2014/117848 | A1 | 8/2014 |
| WO | WO 2015/044151 | A2 | 4/2015 |
| WO | WO 2015/065387 | A1 | 5/2015 |
| WO | WO 2015/115905 | A1 | 8/2015 |

OTHER PUBLICATIONS

United Kingdom Search Report, issued in Priority Application No. 1618747.8. dated Feb. 15, 2018.

Written Opinion of the International Searching Authority, issued in PCT/NO2017/050285, dated Jan. 19, 2018.

United Kingdom Combined Search and Examination Report issued in United Kingdom Application No. 1618747.8, dated Feb. 2, 2017.

United Kingdom Search Report, issued in United Kingdom Application No. 1618747.8, dated Apr. 13, 2018.

* cited by examiner

METHOD OF PLUGGING AND PRESSURE TESTING A WELL

TECHNICAL FIELD

The present invention relates to a method of plugging a well extending into a hydrocarbon bearing formation. The invention also relates to a method of pressure testing the plugged well. The invention also provides an apparatus for plugging and pressure testing a well.

BACKGROUND

Oil and gas wells have in general three different purposes, as producers of hydrocarbons, injectors of water or gas for reservoir pressure support or for depositing purposes, or as exploration wells. At some point it is likely to be necessary to satisfactorily plug and seal these wells, e.g. after the wells have reached their end-of life and it is not economically feasible to keep the wells in service (so-called "plug and abandon"), or for some temporary purpose (e.g. "slot recovery"). Plugging of wells is performed in connection with permanent abandonment of wells due to decommissioning of fields or in connection with permanent abandonment of a section of well to construct a new wellbore (known as side tracking or slot recovery) with a new geological well target.

A well is constructed by drilling a hole into the reservoir using a drilling rig and then inserting sections of steel pipe, casing or liner into the hole to impart structural integrity to the wellbore. Cement is injected between the outside of the casing or liner and the formation and then tubing is inserted into the casing to connect the wellbore to the surface. For ease of reference, all of these entities inserted into the well are referred to here as "tubulars". When the reservoir is to be abandoned, either temporarily or permanently, a plug must be established across the full cross-section of the well. This is generally achieved by removal of the tubulars from the well bore by pulling the tubulars to the surface or by section milling. Plugs are then established across the full cross-section of the well, in order to isolate the reservoir(s) and prevent flow of formation fluids between reservoirs or to the surface. It is generally necessary to remove the tubulars from the wellbore because in general it is not possible to be certain that the quality of the sealant (e.g. cement) behind the tubular(s), i.e. between the tubular(s) and the formation, is adequate to form part of the plug—thereby necessitating the installation and verification of a completely new cross-sectional plug.

To save having to remove an entire length of tubular from a well, a tool may be inserted into the well to cut the tubulars at a point beneath that at which the plug is to be formed, with only the upper detached parts of the tubulars being removed from the well. It is also possible to use a milling tool to mill away a part of the tubulars at the location where the plug is to be formed or to use explosive charges or perforation guns to remove parts of the tubular at said location.

An improperly plugged well is a serious liability so it is important to ensure that the well is adequately plugged and sealed. However, it can be difficult to accurately determine the quality of a well plug, and regulations will therefore typically over specify plug requirements by some significant margin. Regulations may require for example that an abandoned well be plugged so as to seal the well over at least 50 metres. In the event that the quality of a plug can be adequately determined in situ, it may be possible to relax the requirements, e.g. reduce the length of the plug, without compromising safety. A reduced plug length may significantly reduce operational costs.

WO 2014/117848 relates to a method of pressure testing a plugged well for the purpose of determining plug quality. According to this document, two or more plugs are formed in a well at longitudinally spaced-apart locations. A fluid communication path is provided between the surface of the well and an intermediate space between adjacent plugs. Pressure testing of the plugs is performed by introducing a fluid under pressure into the intermediate space. The fluid is introduced through the fluid communication path. Pressure sensors in the intermediate region then enable the integrity of at least one of the plugs to be determined.

WO 2015/044151 relates to a method of sealing a well in which a wireline is employed to locate a stinger in a location within a wellbore where one or more openings have been created in a tubing installed in the wellbore to expose the formation. A sealant, e.g. cement, is injected through the stinger to form a plug at said location.

WO 2014/117846 relates to a method of plugging a well in which one or more explosive charges are detonated within a tubular or tubulars extending through the well in order to remove, fragment and or cut one or more sections of the tubulars around the entire circumference of the well to expose the surrounding formation or cement. The well is subsequently filled in the exposed region with a sealing material so as to form one or more plugs within the well.

U.S. Pat. No. 2,918,124 A, US 2009/260817 A1, US 2003/150614 A1, U.S. Pat. Nos. 5,667,010 A, 3,053,182 A, WO 2012/096580 A1 and US 2005/028980 A1 describe methods relating to well plug and abandonment.

Currently, placement of plugs is typically performed by pumping the cement from the well topside through a drill pipe or coil tubing. Due to uncertainty of placement and contamination with other fluids, a rather long length is required per plug, e.g. 50 m, to achieve the required plug integrity. After the cement is placed and has cured, the cement plug is typically subjected to a large downwards force, for example 10 tonnes, and pressure tested to ensure that the cement is set properly. This constitutes integrity testing of the cement plug, to ensure it meets specified standards for permanent or temporary abandonment of a well, for example.

SUMMARY

A first aspect of the invention relates to a method of plugging a well extending into a formation to facilitate temporary or permanent abandonment of the well. The method comprises conveying a plug placement and verification tool (PPVT) through a tubular, extending through the well, to a plug formation location, the PPVT comprising a stinger for delivering a plugging material into the well, an expandable packer disposed at one end of the stinger and a pressure sensor disposed below the expandable packer. Then the expandable packer is operated to form a seal in the well above the pressure sensor. Then a plugging material is delivered from the stinger into a region of the well above the expandable packer, thereby forming a plug in the well. Thereafter a pressure change is created above the plug and the integrity of the plug is verified using the pressure sensor.

A "stinger" in the context of the invention may be a tubular, with or without attached instrumentation, through which sealant is deployed.

Prior to the step of conveying the PPVT through the tubular to the plug formation location, a mechanical plug or packer may be installed below the plug formation location. The mechanical plug may be a bridge plug.

The method may further comprise, prior to said step of conveying, forming openings in the tubular to expose the formation at least at a first upper location and a second lower location, wherein: the mechanical plug is installed below the second location; and the expandable packer is sealed against a section of the tubular between the first and second locations.

Verifying the integrity of the plug may comprise detecting changes in an output of the pressure sensor. The PPVT may further comprise one or more temperature sensors and the method may further comprise utilizing the one or more temperature sensors to monitor the plugging material hydration during said step of delivering the plugging material from the stinger.

A signal from the pressure sensor may be transmitted to the wellhead through or via the stinger of the PPVT. Alternatively, signals representative of readings from the pressure sensor and/or the one or more temperature sensors may be transmitted wirelessly through the plug, i.e. through the plugging material during and/or after it has been delivered from the stinger into the plug formation location. The wireless transmission may be by means of either, or a combination of, electromagnetic or acoustic waves. For example, a radio-frequency transmitter may be located proximate the pressure sensor, e.g. within or adjacent to the expandable packer. A corresponding radio-frequency receiver may be located on the stinger at a location which is above the plug once it is formed, whereby the transmitter and receiver are arranged to provide a data communication link from the pressure sensor and/or one or more temperature sensors at a suitable frequency. The receiver may be in communication with the wellhead through or via the stinger of the PPVT or via a cabled/fibre optic connection running along the stinger body, in order to relay the pressure and/or temperature sensor readings to the surface. Alternatively, the receiver may be placed at the wellhead itself, if the radio frequency is chosen such that a reliable wireless communication link may be established directly between the transmitter located below the plug and the receiver located at the wellhead. The PPVT may be conveyed on a wireline, drillpipe, or coiled tubing.

The method may further comprise disconnecting the PPVT from the wireline or drill pipe and retrieving the wireline or drill pipe to the surface, leaving the PPVT in situ, thereby forming part of the plug.

The method may further comprise, prior to said step of delivering, disconnecting the stinger from the expandable packer and pressure sensor and, after placement of the plugging material, retrieving the stinger to the surface on the wireline or drill pipe whilst leaving the pressure sensor in place.

The method may further comprise vibrating the PPVT during said step of delivering.

A second aspect of the invention relates to a plug placement and verification tool (PPVT) comprising a stinger, an expandable packer disposed at one end of the stinger;

and a pressure sensor disposed below the expandable packer.

The PPVT may further comprise one or more temperature sensors distributed along the stinger, above the expandable packer. The stinger may comprise a number of nozzles for delivering the plugging material.

For efficient plugging of wells, the inventors have appreciated that it would be desirable to reduce the length of the plug. However, in order to reduce the length of the plug, verification/integrity testing becomes more important. Furthermore, it would be desirable to be able to verify the plug using the same tool as is used to place the plug.

The inventors have appreciated that it is desirable to perform pressure testing of a plug contemporaneously with the plug formation without requiring additional rig/wireline time/trips and without compromising the assessment of the quality of the plug. Indeed, the assessment of the quality of the plug may actually be improved over conventional methods.

The invention may enable placement of shorter yet improved plugs that can be tested and verified without any extra conveyance time, e.g. the invention may eliminate the need to trip a separate verification tool down the well after placement of the plug. Embodiments of the present invention may utilize a single tool to both place and verify a plug. Furthermore, the tool itself may become part of the permanent plug and need not be retrieved from the well after placement of the plug—thereby saving cost/time and reducing operational complexity. The tool may also be used to enable transmission of signals from pressure and temperature gauges through the tool body without having any effect on the integrity of the plug.

A third aspect of the invention relates to a method of plugging a well extending into a formation to facilitate temporary or permanent abandonment of the well. The method comprises conveying a plug placement and verification tool (PPVT) through the well, to a plug formation location, the PPVT comprising a stinger for delivering a plugging material into the well, an expandable packer disposed at one end of the stinger, and one or more sensors, and operating the expandable packer to form a seal in the well. The method further comprises delivering a plugging material from the stinger into a region of the well above the expandable packer, thereby forming a plug in the well, and thereafter leaving the stinger in situ to provide a communication path, through the set plug, for signals output by the sensor(s).

A fourth aspect of the invention relates to method of plugging a well extending into a formation to facilitate temporary or permanent abandonment of the well. The method comprises conveying a plug placement and verification tool (PPVT) through the well, to a plug formation location, the PPVT comprising a stinger for delivering a plugging material into the well, an expandable packer disposed at one end of the stinger, and a cup packer located above injection nozzles of the stinger, operating the expandable packer to form a seal in the well, and delivering a plugging material from the stinger into a region of the well above the expandable packer and beneath the cup packer, thereby forming a plug in the well.

Each of the above aspects of the invention may be adapted such that the stinger for delivering a plugging material into the well, the expandable packer and the pressure sensor disposed below the expandable packer do not form a single device (i.e. a single PPVT) but rather are run into the well as separate elements. For example, a first element may comprise the expandable packer with a pressure sensor (and optionally also temperature sensors) on the underside thereof, whilst a second element may comprise the stinger for delivering a plugging material into the well and also, in the fourth aspect, a cup packer located above the injection nozzles of the stinger. The first element may be run into the well first, i.e. before the stinger, and the expandable packer may be sealed against a section of the tubular between the first and second locations. Then, at a later time, the stinger may be landed onto the expandable packer before placing the plugging material. In such an example, it may be advantageous that the pressure and/or temperature sensors communicate with the stinger/wellhead wirelessly such that a cabled connection need not be established between the stinger and the already-installed expandable packer once the stinger is landed thereon.

DETAILED DESCRIPTION

Figure 1A:
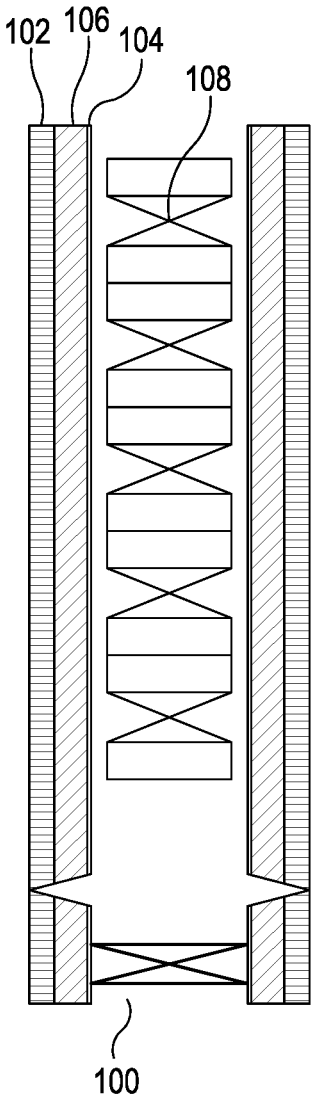
FIGS. 1*a*-1*c* illustrate schematically stages in the preparation of a well casing by explosive removal of portions thereof to expose the surrounding formation.
Figure 1B:
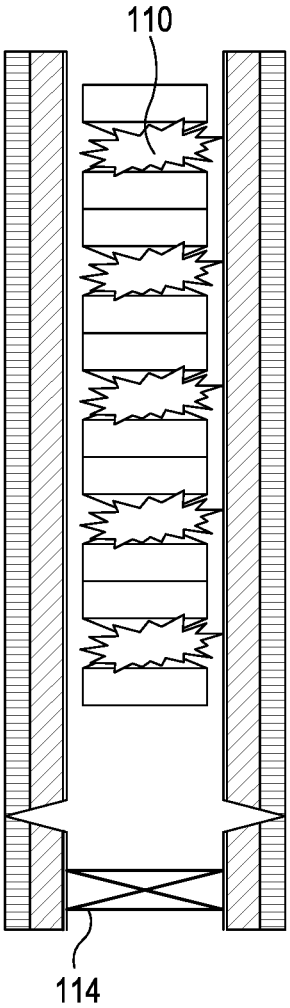
Figure 1C:
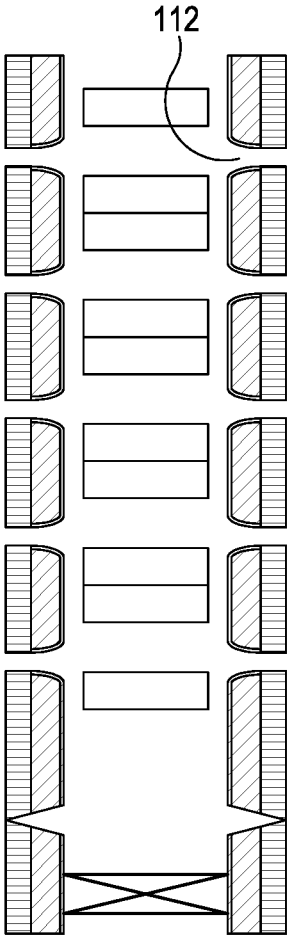

With reference to FIGS. 1*a*-1*c*, a well comprises a wellbore 100 within a surrounding formation 102. Situated within the wellbore is a casing (tubular) 104 and a cement layer 106 between the casing and the formation. A liner or other tubular may previously have been removed from within the casing, at least over the interval to be plugged. Alternatively, such a liner or other tubular may remain within the casing, ultimately being embedded within the plug.

The casing in a well interval to be plugged is opened by any feasible method. For example, in FIGS. 1*a*-1*c* shorter sections of the casing are opened radially by use of explosive charges 108. A method utilizing such charges is described in WO 2014/117846 A1. The charges are detonated 110, FIG. 1*b*, which results in a plurality of cuts 112, FIG. 1*c*, within the casing around substantially the entire circumference of the casing—thereby exposing the surrounding formation and cement. Between the cuts the casing remains substantially intact. Alternative methods that can open the casing towards formation may be used, for example by section milling or by perforate, wash and cement (PWC), or a PWC-like process where a sealant other than cement is used.

Figure 2:
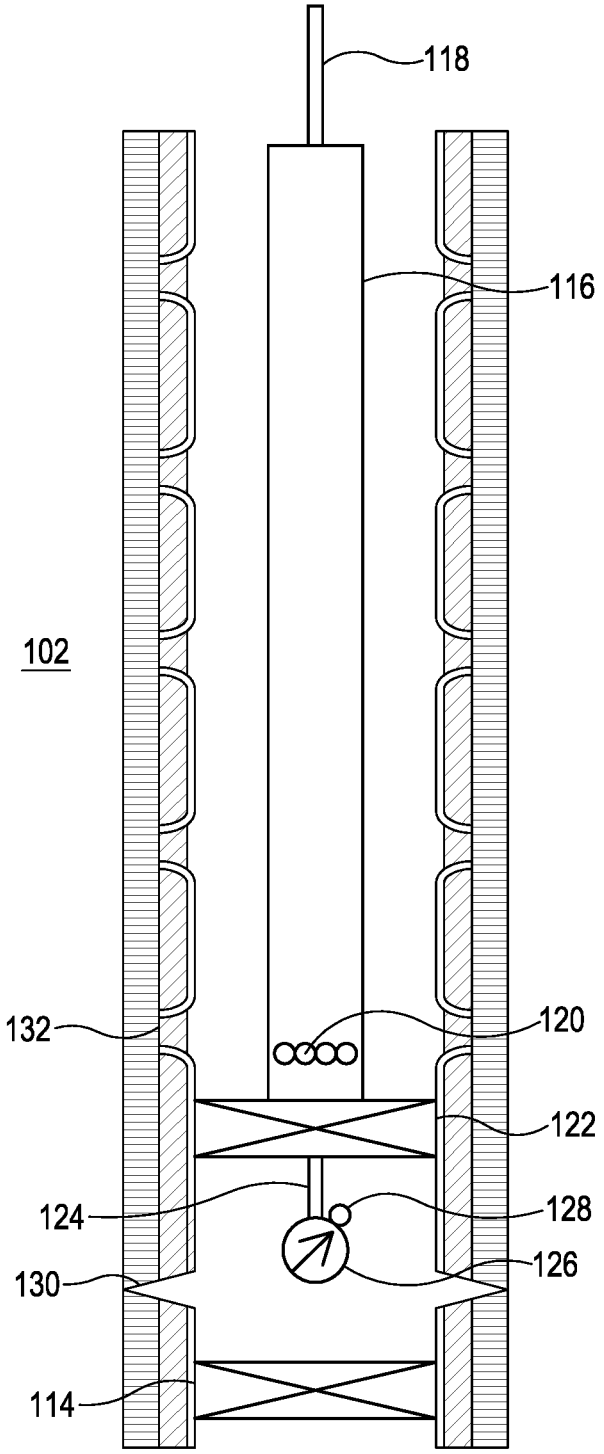
FIG. 2 shows a plug placement and verification tool (PPVT) positioned in a well at a plug formation location prior to placement of a plug.

With reference to FIGS. 1*a*-1*c* and 2, a mechanical plug 114 is installed below the opened interval. The mechanical plug may be placed either before or after removal of the casing. As illustrated in FIG. 2, the mechanical plug is placed below the lower-most opened section, such that the casing below the mechanical plug is substantially intact. One skilled in the art would know how to place a mechanical plug 114 as depicted in FIG. 2 and thus specific details are not provided here. The mechanical plug may be e.g. a bridge plug or similar.

A plug placement and verification tool (PPVT) 116 is lowered down to the opened area, conveyed using drill pipe, coil tubing or wireline 118. Conveyance by means of a wireline may be most cost effective. This is illustrated in FIG. 2. The PPVT comprises an elongate tubular body having one or more nozzles 120 for placement of the plug material, i.e. this elongate tubular body section of the PPVT could be a conventional stinger. An expandable packer 122 is situated on the end of the elongate tubular body, below the nozzles. Below the expandable packer is a tool head 124 comprising a pressure sensor 126 and a temperature sensor 128. In some embodiments there may not be a temperature sensor 128 on the tool head 124. The expandable packer and tool head may be a single unit which is secured onto the stinger section (elongate tubular body of the PPVT) prior to deployment of the PPVT down the well.

The PPVT is located in the well such that the expandable packer 122 is situated above the lowest perforation zone 130 (or opened casing section) but below the penultimate perforation zone 132. In general, it is sufficient that there be at least one perforated zone below the expandable packer of the PPVT. The expandable packer is actuated once the PPVT has been lowered to the correct location. The packer forms a substantially pressure-tight seal. Thus a small 'test volume' is formed between the expandable packer 122 and the mechanical plug 114 below it. This test volume allows for highly sensitive monitoring of pressure changes within it using the pressure sensor 126, optionally in conjunction with the temperature sensor 128 to monitor other properties of the test volume, thereby gaining additional information about the test volume region. If the volume were much larger, e.g. if there were no mechanical plug 114 below the expandable packer, it may not be possible to make such sensitive pressure measurements. Thus the inventors have appreciated that by forming a small test volume the measurement sensitivity is improved, thereby enabling a more reliable and sensitive certification of the plug performance. However, the invention could still be operated without the mechanical plug 114 being installed below the expandable packer—albeit with a potentially reduced pressure measurement sensitivity. Furthermore, the invention could also be operated without the plurality of discrete openings as illustrated in the drawings, and the expandable packer could instead be expanded against the formation in a large opened region, with exposed formation above and below the expandable packer.

Figure 3:
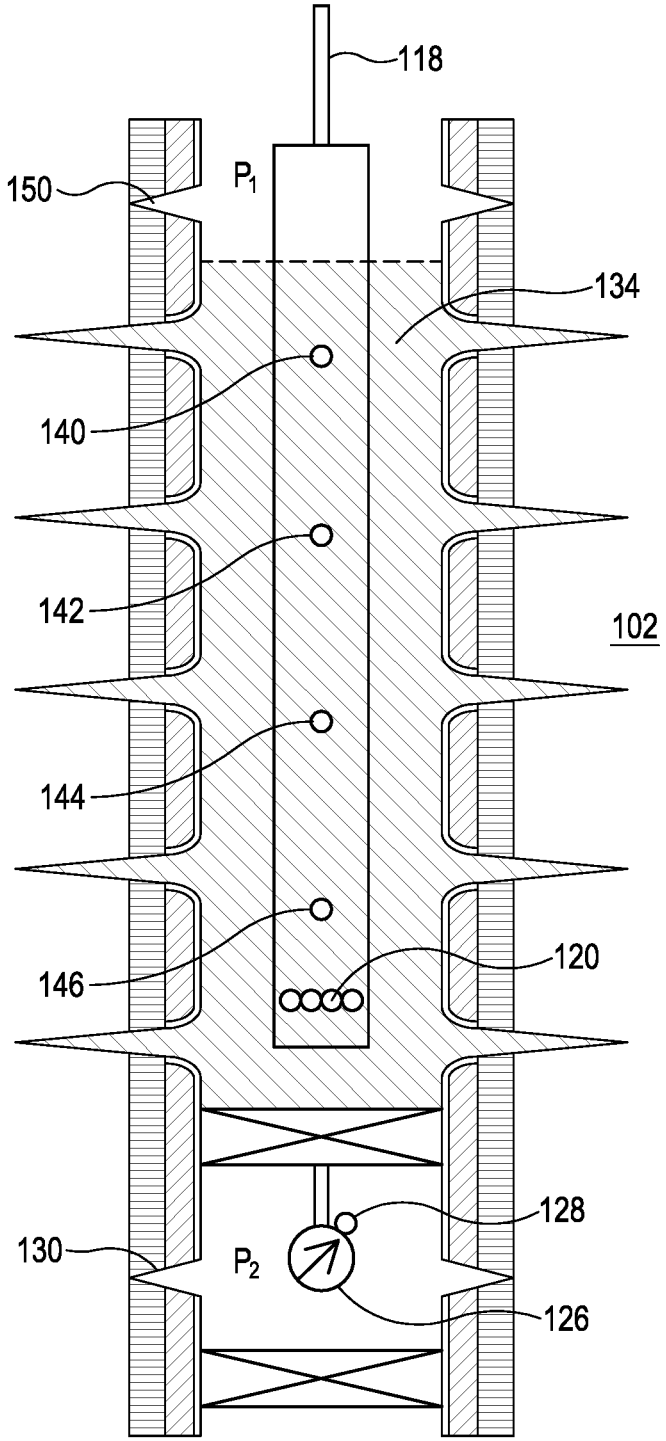
FIG. 3 shows placement of a plug using the PPVT of FIG. 2.

With reference to FIG. 3, once the PPVT is in the correct position, the stinger is released from the expandable packer and the nozzles 120 on the PPVT are opened and a plugging material 134 is pumped out of the PPVT, displacing any annulus fluid which may reside on the outside of the tool and replacing it with the plugging material to form the plug. The placement of the plugging material may either be through the nozzles of the PPVT stinger or through the bottom of the stinger itself. For example, when the stinger is released from the expandable packer, as shown in FIG. 3, the plugging material may be pumped out of the bottom of the stinger rather than, or in addition to, out of the nozzles. Vibrational forces might be beneficial during this part of the procedure. The plug material can be anything that is capable of forming a permanent plug, such as cement. The plug material is placed so that it is balanced on the outside and inside of the stinger (i.e. so that the hydrostatic pressure is the same on the inside and outside of the stinger)—thereby forming a cross-sectional plug from formation to formation, through the annulus and the PPVT. During placement of the plug, it is ensured that there is at least one perforated or opened casing section above the plug, e.g. the upper-most perforated zone 150, as shown in FIG. 3.

Alternatively, the stinger may remain attached to the expandable packer when the nozzles on the PPVT are opened. As such, the stinger becomes part of the final plug and is not retrieved to the surface. Other aspects of the method as described above apply also to this scenario.

Once the plug material has cured, the pressure above the plug 134 can be either decreased or increased in order to perform a pressure test of the plug. The tool head 124 of the PPVT has pressure and temperature sensors 126, 128 which can send pressure and temperature readings through the PPVT body and further up the well. The signals can be transmitted up the well, either by mud pulsing or through the casing by a connector device between the PPVT tool and the casing. For example, in the case where the stinger is released from the expandable packer prior to forming the plug, signals may be transmitted from the pressure/temperature sensors below the expandable packer using mud pulsing—the signals being picked up by a receiver on the stinger or drill pipe/wireline above the plug and transmitted further up the well by electromagnetic means, e.g. using a cable or signal on pipe arrangement. Alternatively, in the case where the stinger remains attached to the expandable packer during placement of the plug, the body of the PPVT tool may act as a conductive bridge between the sensors below the expandable packer and the well casing above. In both scenarios the stinger facilitates transmission of data collected by the sensors to the wellhead for monitoring conditions in the well. Alternatively, the PPVT may have fibre optic cables incorporated into it (e.g. in the wall of the PPVT) to facilitate the transmission of data signals from the pressure and/or temperature sensors on the tool head further up the well towards the wellhead. The fibre optic cables themselves may also act as distributed or localised pressure and temperature sensors.

In some embodiments, signals representative of readings from the pressure sensor and/or the one or more temperature sensors may be transmitted wirelessly through the plug, i.e. through the plugging material during and/or after it has been delivered from the stinger into the plug formation location. The wireless transmission may be by means of either, or a combination of, electromagnetic or acoustic waves. For example, a radio-frequency transmitter may be located proximate the pressure sensor, e.g. within or adjacent to the expandable packer. A corresponding radio-frequency receiver may be located on the stinger at a location which is above the plug once it is formed, whereby the transmitter and receiver are arranged to provide a data communication link from the pressure sensor and/or one or more temperature sensors at a suitable frequency. The receiver may be in communication with the wellhead through or via the stinger of the PPVT or via a cabled/fibre optic connection running along the stinger body, in order to relay the pressure and/or temperature sensor readings to the surface. Alternatively, the receiver may be placed at the wellhead itself, if the radio frequency is chosen such that a reliable wireless communication link may be established directly between the transmitter located below the plug and the receiver located at the wellhead The integrity of the plug can be tested (a process known as "integrity testing") by applying a differential pressure across the full length of the plug, and monitoring the pressure below the plug in real time. In FIG. 3, a pressure P1 is applied above the plug 134 whilst the pressure P2 below the plug—in the interval between the expandable packer and the mechanical plug—is monitored. If the integrity of the plug is good one would not expect the pressure P2 below the plug to change as the pressure P1 is applied above the plug. This is because, in the absence of any leakage through the plug, e.g. between the formation and the side of the plug, there is no fluid communication path between the top side of the plug closest to the well head and the bottom of the plug. The small interval between the expandable packer and the mechanical plug effectively acts as a small test volume which enables highly-sensitive monitoring of the plug integrity. It is important that the pressure sensor 126 in this small test volume is linked to the formation which is why there is preferably a perforated zone beneath the plug, e.g. zone 130 in FIG. 3. This allows leakage through the plug to be detected, i.e. by sensing a pressure change in the test volume. It is also important, for the same reason, that there is at least one perforated zone above the plug, which is zone 150 in FIG. 3.

The PPVT may be equipped with additional temperature sensors distributed along the body of the PPVT (which is effectively a long steel tube) above the expandable packer to monitor the cement curing process. The temperature sensors can be distributed along the tool body to monitor cement hydration during and after placement. FIG. 3 shows the PPVT after formation of the plug wherein 140-146 are additional temperature sensors. Any number of temperature sensors could be used depending on the length of the plug.

Figure 4:
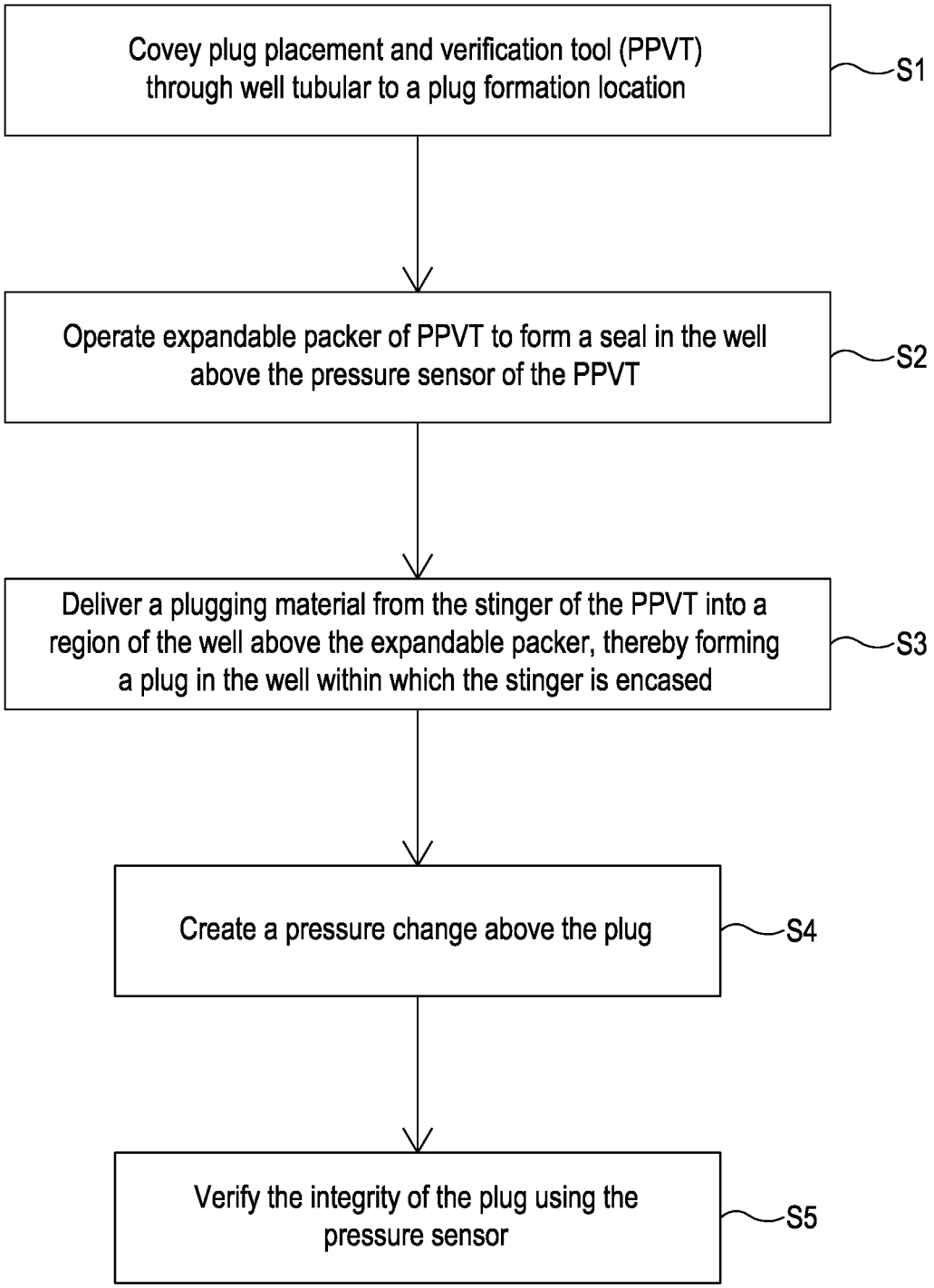
FIG. 4 is a flow diagram illustrating a method of plugging and pressure testing a well.

FIG. 4 is a flow chart relating to a method of plugging a well according to an embodiment of the invention. The method entails conveying a PPVT through the well tubular to a plug formation location, S1. Once at the plug formation location the expandable packer of the PPVT is operated to form a seal in the well above the pressure sensor of the PPVT, S2. A plugging material is then delivered from the stinger of the PPVT into a region of the well above the expandable packer, thereby forming a plug in the well, S3. Once the plug has been formed and set a pressure change is created above the plug, e.g. by increasing a fluid pressure in the well above the plug, S4. The plug integrity is verified by monitoring readout from the pressure sensor which is located below the plug, S5.

Figure 5:
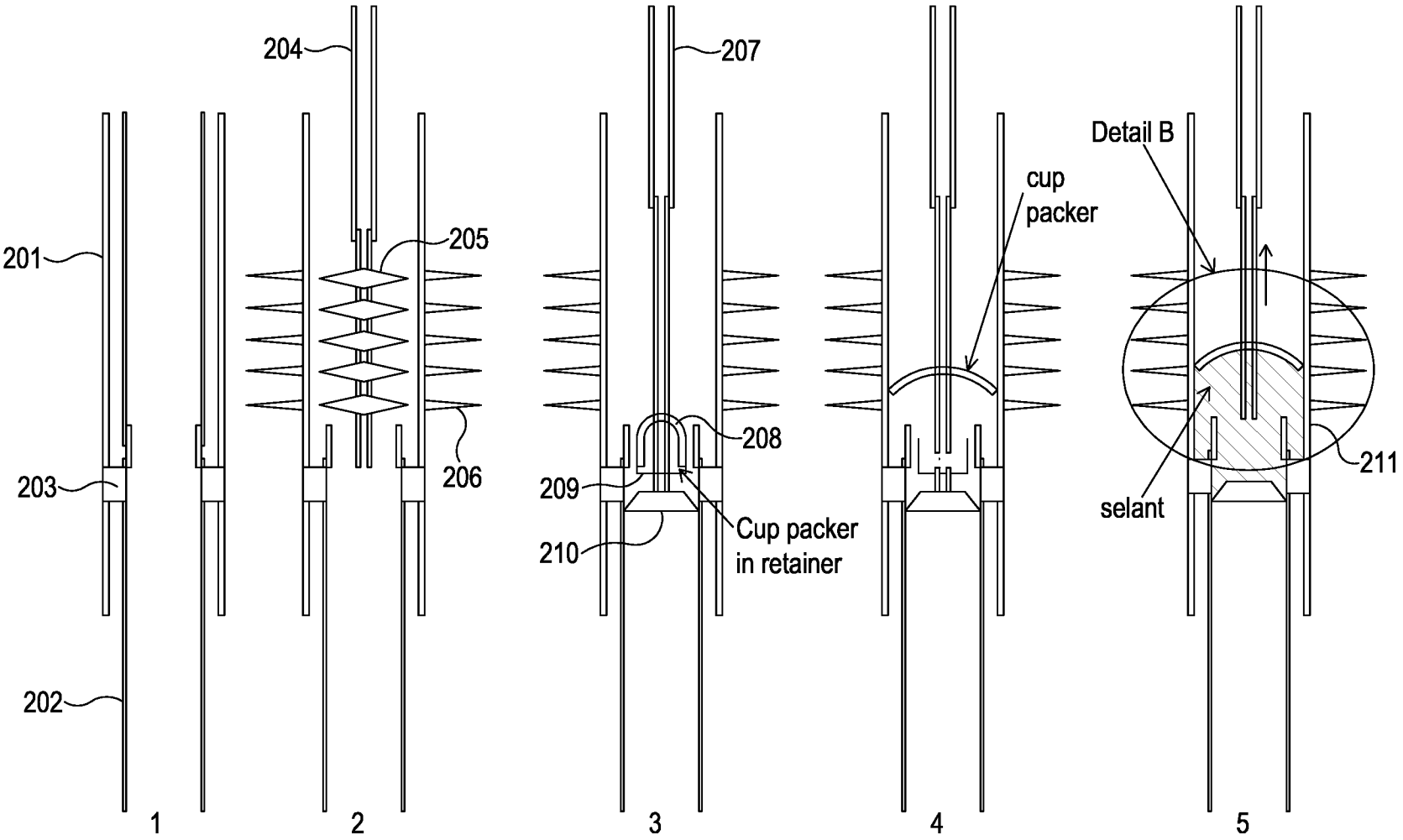
FIG. 5 illustrates a procedure for forming a plug downhole and which utilises a cup packer.

FIG. 5 illustrates a sequence of steps, 1 to 5 forming part of an alternative procedure for plugging a well. Reference numeral 201 indicates the cemented-in casing, whilst numeral 202 indicates a production liner. Numeral 203 indicates a production packer. In step 1, the production liner is intact within the casing, but is removed above the production packer at step 2. Thereafter a wireline 204 is used to introduce a perforation gun 205 into the casing. Detonation of the gun results in perforation of the casing as illustrated by numeral 206.

After removal of the wireline with attached perforation gun, at step 3 a cement stinger 207 is introduced into the casing, at a location adjacent to the perforations. The cement stinger is provided with nozzles close to its lower end in order to allow cement to be pumped through the stinger into the region adjacent to and above the production liner. Just above the nozzles, a cup packer 208 is provided within a retainer 209. A mechanical packer 210 is attached to the bottom of the stinger, beneath the nozzles. In FIG. 3, the packer 210 has been activated in order to close the space within the production liner 202.

Step 4 illustrates the situation following raising of the stinger 207 by a small amount in order to release it from the packer 210. This also releases the cup packer 208 from the retainer 209, causing the cup packer to expand and come into contact with the casing 201. To facilitate this expansion, the cup packer may be made of a resilient elastomeric material which allows the containment of the packer within the retainer prior to its release.

Step 6 illustrates the pumping of a sealant, e.g. cement through the stinger 207 and the exit nozzles, into the space above the mechanical packer 210. Due to the concave shape of the cup packer 208, the force exerted by the injected cement forces the cup packer against the casing wall, further enhancing the sealing effect. This in turn pushes the cup packer and the stinger upwards until a plug 211 of sufficient axial extent has been created. To facilitate upward movement of the cup packer and the stinger, at the well head the stinger may be mounted on a hydraulic piston or suchlike.

Figure 6:
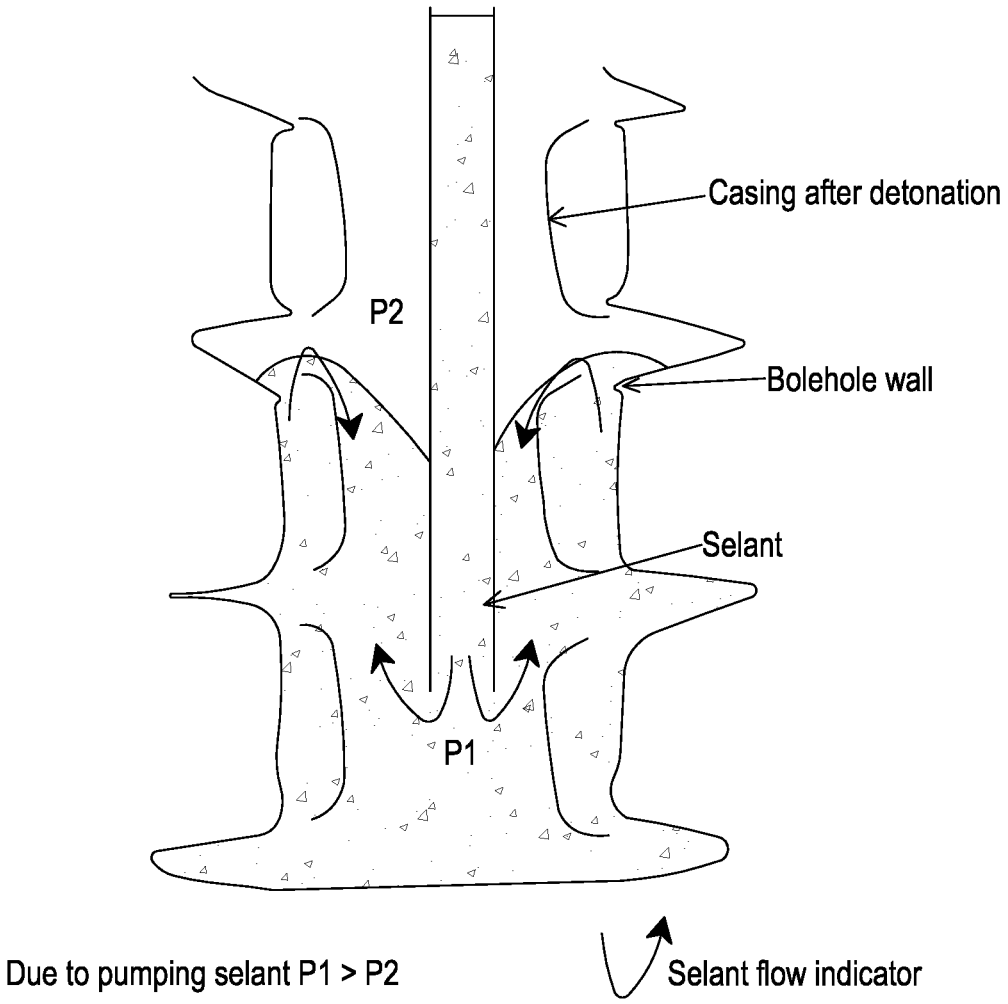
FIG. 6 illustrates in detail plug formation using a cup packer.

FIG. 6 illustrates a detail of the apparatus and procedure of step 5 of FIG. 5, showing the sealant flowing out of the stinger into the interior of the casing and then out through the perforations into the surrounding formation.

FIGS. 5 and 6 do not show the mechanical packer and pressure sensor described above with reference to FIGS. 2 and 3. However, it is envisaged that these are present in order to enable pressure testing of the plug established using the cup packer.

Whilst in the above-described embodiments the PPVT comprises at least a stinger, expandable packer and sensors as a single tool, in alternative embodiments the stinger, expandable packer and the pressure sensor disposed below the expandable packer do not form a single device (i.e. a single PPVT) but rather are run into the well as separate elements. In an exemplary embodiment, a first element comprises the expandable packer with a pressure sensor (and optionally also temperature sensors) on the underside thereof, whilst a second element comprises the stinger for delivering a plugging material into the well and optionally also a cup packer located above the injection nozzles of the stinger. The first element may be run into the well first, i.e. before the stinger, and the expandable packer may be sealed against a section of the tubular between the first and second locations. Then, at a later time, the stinger may be landed onto the expandable packer before placing the plugging material. In such an example, it may be advantageous that the pressure and/or temperature sensors communicate with the stinger/wellhead wirelessly, as described above, such that a cabled connection need not be established between the stinger and the already-installed expandable packer once the stinger is landed thereon.

It will be appreciated by the person of skill in the art that various modifications may be made to the above described embodiments without departing from the scope of the present invention. In particular, it will be appreciated that various alternative methods of forming the (cement/sealant) plug may be used instead of those described above.

The invention claimed is:

1. A method of plugging a well extending into a formation to facilitate temporary or permanent abandonment of the well, the method comprising:

conveying a plug placement and verification tool (PPVT) through the well, to a plug formation location, the PPVT comprising a stinger for delivering a plugging material into the well, an expandable packer disposed at one end of the stinger and a pressure sensor disposed below the expandable packer;

operating the expandable packer to form a seal in the well above the pressure sensor;

delivering a plugging material from the stinger into a region of the well above the expandable packer, thereby forming a plug in the well; and thereafter creating a pressure change above the plug and verifying the integrity of the plug using the pressure sensor.

2. The method according to claim 1, further comprising, prior to said step of conveying the PPVT to the plug formation location, installing a mechanical plug or packer below the plug formation location.

3. The method according to claim 2, wherein the mechanical plug is a bridge plug.

4. The method according to claim 2, said mechanical plug or packer being installed across the full extent of the casing or within a liner remaining within the casing.

5. The method according to claim 2, further comprising, prior to said step of conveying, forming openings in a well casing to expose the formation at least at a first upper location and a second lower location, wherein:

the mechanical plug or packer is installed below the second location; and the expandable packer is sealed against a section of the casing, or against a liner within the casing, between the first and second locations.

6. The method according to claim 1, wherein said step of verifying the integrity of the plug comprises detecting changes in an output signal provided by the pressure sensor.

7. The method according to claim 1, wherein the PPVT further comprises one or more temperature sensors and the method further comprises utilizing the one or more temperature sensors to monitor the plugging material hydration during or following said step of delivering the plugging material from the stinger.

8. The method according to claim 1, wherein a signal from the pressure sensor is transmitted to the wellhead through or via the stinger of the PPVT.

9. The method according to claim 1, wherein the PPVT is conveyed on a wireline or drillpipe.

10. The method according to claim 1, further comprising leaving the stinger in situ following delivery of the plugging material, thereby forming part of the plug once set.

11. The method according to claim 10, wherein, following placement of the plug, the stinger provides a communication path, through the set plug, for signals output by the sensor (s).

12. The method according to claim 1, further comprising, prior to said step of delivering, disconnecting the stinger from the expandable packer and pressure sensor and, after placement of the plugging material, retrieving the stinger to the surface on the wireline or drill pipe whilst leaving the pressure sensor in place.

13. The method according to claim 1, further comprising vibrating the stinger during said step of delivering.

14. The method according to claim 1, wherein said stinger comprises a cup packer located above injection nozzles provided in the stinger, the cup packer increasing the plugging material injection pressure.

15. The method according to claim 1, wherein the step of delivering the plugging material and forming the plug in the well and the step of verifying the integrity of the plug using the pressure sensor are performed in a same trip of the PPVT.

16. The method according to claim 1, wherein the pressure sensor remains disposed below the expandable packer after the plug is formed by the step of delivering the plugging material, and the pressure sensor is disposed below a distal end of the stinger and thus below the entirety of the plugging material forming the plug.

17. The method according to claim 1, further comprising the steps of:

prior to said step of conveying the PPVT to the plug formation location, installing a mechanical plug or packer below the plug formation location; and forming a plurality of perforation zones to expose the formation, wherein the mechanical plug or packer is situated below a lowest perforation zone of the plurality of perforation zones, and the expandable packer is situated above said lowest perforation zone but below a penultimate perforation zone of the plurality of perforation zones, such that an interval between the expandable packer and the mechanical plug or packer acts as a small test volume which enables highly-sensitive monitoring of the integrity of the plug.

18. A method of plugging a well extending into a formation to facilitate temporary or permanent abandonment of the well, the method comprising:

conveying a plug placement and verification tool (PPVT) through the well, to a plug formation location, the PPVT comprising a stinger for delivering a plugging material into the well, an expandable packer disposed at one end of the stinger, and one or more sensors;

operating the expandable packer to form a seal in the well;

delivering a plugging material from the stinger into a region of the well above the expandable packer, thereby forming a plug in the well; and thereafter leaving the stinger in situ to provide a communication path, through the set plug, for signals output by the sensor(s).

* * * * *